US006631685B2

(12) United States Patent
Hewitt

(10) Patent No.: US 6,631,685 B2
(45) Date of Patent: Oct. 14, 2003

(54) DUAL FRICTION WEAR PLATE ASSEMBLY FOR A RAILCAR SIDE FRAME SADDLE

(75) Inventor: Paul Hewitt, Angus (GB)

(73) Assignee: Meridian Rail Information Systems Corp., Lombard, IL (US)

( * ) Notice: Subject to any disclaimer, the term of this patent is extended or adjusted under 35 U.S.C. 154(b) by 0 days.

(21) Appl. No.: 09/946,660

(22) Filed: Sep. 5, 2001

(65) Prior Publication Data

US 2002/0104814 A1 Aug. 8, 2002

Related U.S. Application Data

(60) Provisional application No. 60/231,559, filed on Sep. 11, 2000.

(51) Int. Cl.[7] ..... B61F 3/00

(52) U.S. Cl. ..... 105/206.1; 105/218.2

(58) Field of Search ..... 105/167, 224.1, 105/225, 226, 199.3, 206.1, 218.2, 193, 198, 193.3, 198.2, 198.4, 198.5, 198.7, 201; 384/42; 188/215 R; 213/50

(56) References Cited

U.S. PATENT DOCUMENTS

| | | | | |
|---|---|---|---|---|
| 1,667,453 | A | * | 4/1928 | Barrows |
| 2,207,848 | A | | 7/1940 | Barrows |
| 3,394,662 | A | * | 7/1968 | Weber ..... 105/165 |
| 3,517,620 | A | | 6/1970 | Weber |
| 3,554,618 | A | | 1/1971 | Ditzler et al. |
| 3,834,320 | A | * | 9/1974 | Tack |
| 3,835,789 | A | | 9/1974 | Sinclair |
| 3,841,233 | A | | 10/1974 | Sinclair |
| 3,882,794 | A | | 5/1975 | Stieler et al. |
| 4,003,316 | A | | 1/1977 | Monselle |
| 4,080,016 | A | | 3/1978 | Wiebe |
| 4,109,586 | A | | 8/1978 | Briggs et al. |
| 4,196,671 | A | | 4/1980 | Herring, Jr. et al. |
| 4,244,297 | A | | 1/1981 | Monselle |
| 4,254,712 | A | | 3/1981 | O'Neil |
| 4,478,154 | A | * | 10/1984 | Holden et al. |
| 4,574,707 | A | | 3/1986 | Hickman |
| 4,915,031 | A | * | 4/1990 | Wiebe |
| 5,226,369 | A | | 7/1993 | Weber |
| 5,386,783 | A | | 2/1995 | Rhen et al. |
| 5,454,330 | A | | 10/1995 | Rhen |
| 6,276,283 | B1 | * | 8/2001 | Weber |
| 6,290,395 | B1 | * | 9/2001 | Pletschet |

* cited by examiner

*Primary Examiner*—S. Joseph Morano
*Assistant Examiner*—Frantz F. Jules
(74) *Attorney, Agent, or Firm*—Barnes & Thornburg

(57) ABSTRACT

A wear plate assembly adapted to engage a friction wedge of a railroad car truck. The wear plate assembly includes a base member having an upper wear member adapted to engage the friction wedge. The upper wear member is formed from a first material such as steel. The wear plate assembly includes a lower wear member located adjacent to and below the upper wear member. The lower wear member is adapted to engage the friction wedge and is formed from a second material such as cast iron. The upper wear member has a coefficient friction with the friction wedge of approximately 0.30 and the lower wear member has a coefficient friction with the friction wedge of approximately 0.15. When a rail car is at tare weight the friction wedge will slidably engage the upper wear member and when the rail car is at fully laden weight the friction wedge will slidably engage the lower wear member. The vertical dampening force created by the friction wedge at fully laden weight is thereby less than the dampening force that is created by the friction wedge at tare weight.

15 Claims, 2 Drawing Sheets

DUAL FRICTION WEAR PLATE ASSEMBLY FOR A RAILCAR SIDE FRAME SADDLE

RELATED APPLICATIONS

This application claims the benefit of U.S. Provisional Application No. 60/231,559, filed Sep. 11, 2000.

BACKGROUND OF THE INVENTION

The present invention is directed to a wear plate assembly for the saddle of a railcar truck, and in particular to a wear plate assembly having a first friction surface formed from a first material having a first coefficient of friction and a second friction surface formed from a second material having a second coefficient of friction.

Railroad car trucks include side frames that are resiliently supported at each end by a saddle and a plurality of resilient springs that extend between the saddle and the side frame. The saddle is rotatably mounted to a wheel set of the truck. In order to dampen vertical movement between the side frame and the saddle, a friction wedge is resiliently biased into engagement with a vertical wear plate of the saddle and with the side frame. When the railcar is at tare weight, or unloaded, the springs that support the side frame are extended and the friction wedge will engage the upper portion of the wear plate that is attached to the saddle. When the railcar is at fully laden weight, carrying a full load of goods or material to be transported, the springs supporting the side frame will be compressed and the friction wedge will engage a lower portion of the wear plate that is attached to the saddle.

SUMMARY OF THE INVENTION

A wear plate assembly adapted to engage a friction wedge of a railroad car truck. The wear plate assembly includes a base member including a first wear member and a mounting member having a recess. The first wear member includes a front friction surface adapted to engage the friction wedge. The mounting member is located adjacent to the first wear member. The wear plate assembly includes a second wear member having a front friction surface adapted to engage the friction wedge. The second wear member is adapted to be disposed within the recess of the mounting member and to be attached to the mounting member. The front friction surface of the second wear member is adapted to be located generally coplanar with the front friction surface of the first wear member. The first wear member is formed from a first material such as steel and the second wear member is formed from a second material, which is different than the first material, such as cast iron.

BRIEF DESCRIPTION OF THE DRAWING FIGURES

DETAILED DESCRIPTION OF THE PREFERRED EMBODIMENT

Figure 1:
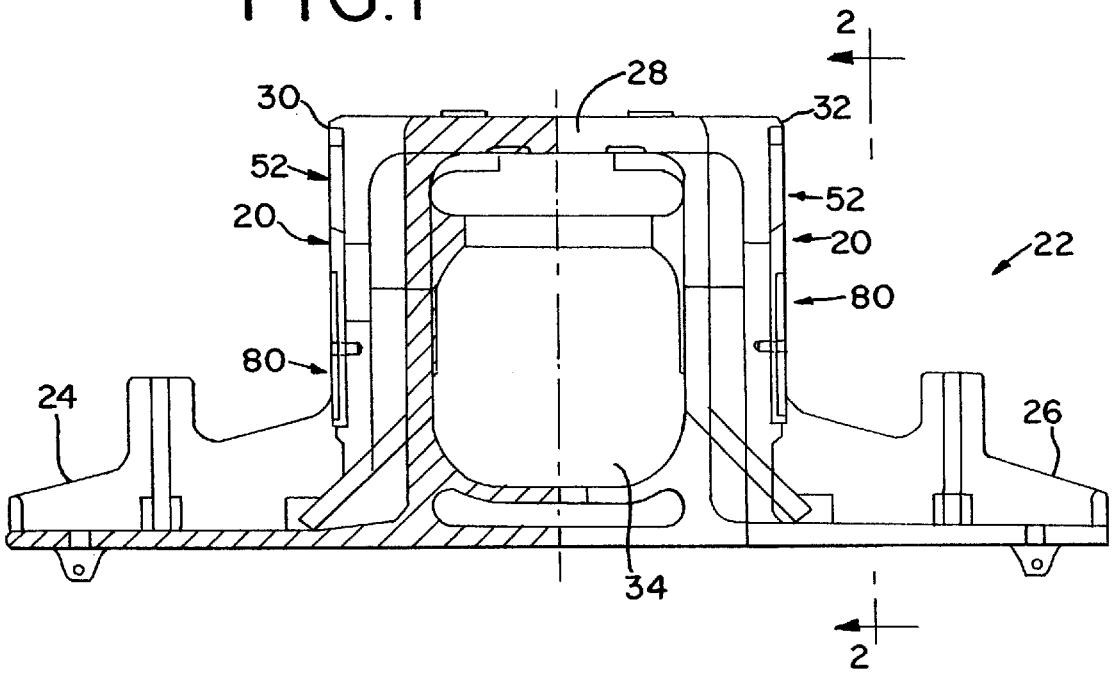
FIG. 1 is a partial cross-sectional side view of a saddle of a railroad car truck including two dual friction wear plate assemblies of the present invention.
Figure 2:
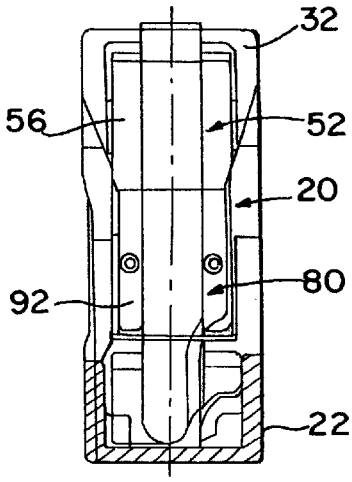
FIG. 2 is a cross-sectional view taken along line 2—2 of FIG. 1.
Figure 3:
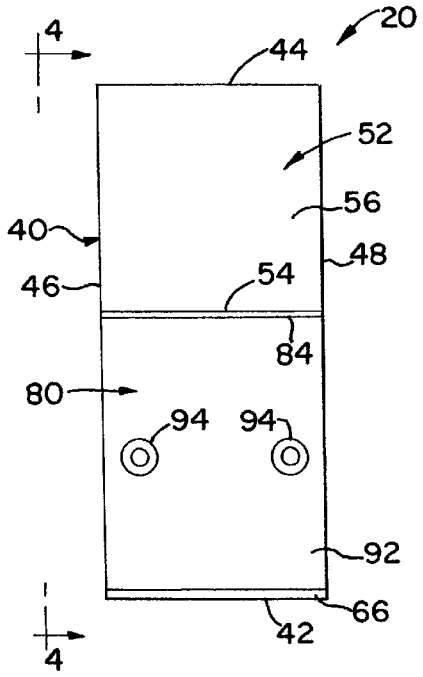
FIG. 3 is a front elevational view of a dual friction wear plate assembly.
Figure 4:
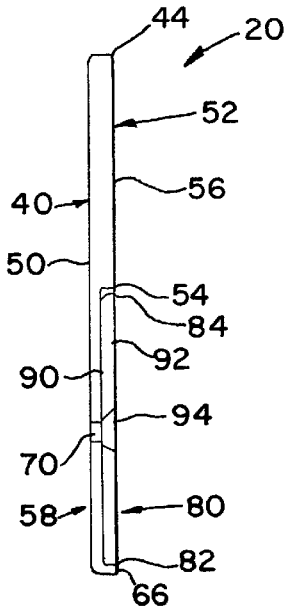
FIG. 4 is a side elevational view taken along line 4—4 of FIG. 3.
Figure 5:
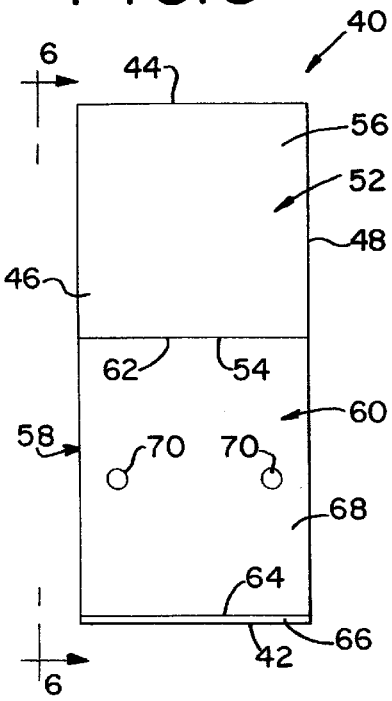
FIG. 5 is a front elevational view of a base member of the dual friction wear plate assembly having a first wear member.
Figure 6:
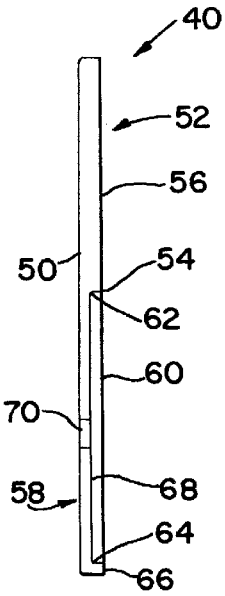
FIG. 6 is a side elevational view taken along line 6—6 of FIG. 5.

Two dual friction wear plate assemblies 20 are attached to a saddle 22, as shown in FIG. 1. The saddle 22 is adapted to resiliently support a side frame (not shown) of a railroad car truck. The saddle 22 includes a first end 24 and a second end 26. Each end 24 and 26 is adapted to receive and support one or more coil springs that resiliently support the side frame. Each end 24 and 26 also respectively supports a resilient coil spring which resiliently biases a friction wedge (not shown), which is generally triangular shaped and which has a vertical planar surface formed from a composite material adapted to engage the wear plate assembly 20 and an inclined surface which is adapted to slidably engage the side frame of the railcar truck, into engagement with the saddle 22 and side frame. The saddle 22 includes an upwardly extending center post 28 having a vertical first side 30 and a vertical second side 32. The saddle 22 includes a central aperture 34 adapted to receive a bearing and the axle of a wheel set.

As best shown in FIGS. 3–6, the wear plate assembly 20 includes a base member 40 which is generally rectangular. The base member 40 includes a generally linear bottom edge 42 that is spaced apart from and generally parallel to a generally linear top edge 44. The base member 40 also includes a generally linear first side edge 46 and a spaced apart and generally parallel linear second side edge 48. The first and second side edges 46 and 48 extend between the bottom and top edges 42 and 44. The base member 40 includes a planar rear surface 50. The base member 40 includes an upper wear member 52 in the form of a rectangular plate. The upper wear member 52 extends between the first side edge 46 and the second side edge 48, and extends from the top edge 44 to a generally linear edge 54 which is located approximately midway between the top edge 44 and the bottom edge 42 of the base member 40 and which extends generally perpendicular between the side edges 46 and 48. The upper wear member 52 includes a generally planar front friction surface 56 which extends between the side edges 46 and 48, the top edge 44 and the edge 54. The friction surface 56 is generally parallel to and spaced apart from the rear surface 50.

The base member 40 includes a mounting member 58 having a pocket or recess 60 which extends from a first wall 62, which extends generally perpendicular to and between the first side edge 46 and the second side edge 48 and which adjoins the edge 54 of the upper wear member 52, to a second wall 64 formed by a lip 66 which extends generally perpendicular to and between the first and second side edges 46 and 48 and which adjoins the bottom edge 42 of the base member 40. The recess 60 also extends between the first side edge 46 and the second side edge 48 of the base member 40. If desired, a lip member may extend along each edge 46 and 48 between the wall 62 and the wall 64. The recess 60 forms a generally planar surface 68 which is generally parallel to the friction surface 56 and the rear surface 50. The base member 40 includes one or more threaded apertures 70 which extend from the rear surface 50 to the surface 68 such that the apertures 70 are in communication with the recess 60. The base member 40 is preferably formed from a first material having a first kinetic coefficient of friction, such as steel which has a kinetic coefficient of friction with composite material of approximately 0.30.

Figure 7:
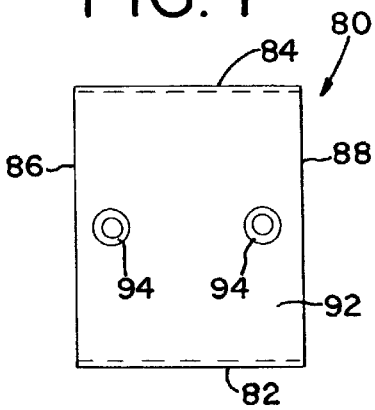
FIG. 7 is a front elevational view of a second wear member of the dual friction wear plate assembly.

The wear plate assembly 20 also includes a lower wear member 80 as best shown in FIG. 7 that is generally rectangular and plate-shaped. The lower wear member 80 includes a generally linear bottom edge 82, a spaced apart and generally parallel linear top edge 84, a generally linear first side edge 86 and a generally linear second side edge 88 spaced apart from and generally parallel to the first side edge 86. The lower wear member 80 includes a generally planar rear surface 90 and a generally planar front friction surface 92 which is spaced apart from and generally parallel to the rear surface 90. The lower wear member 80 includes one or more apertures 94 which are generally conical-shaped, having a larger diameter at the friction surface 92. The thickness of the lower wear member 80 between the rear surface 90 and the friction surface 92 is approximately equal to the depth of the recess 60. The lower wear member 80 is adapted to be located within the recess 60 of the mounting member 58 of the base member 40 such that the top edge 84 of the wear member 80 is located adjacent the edge 54 of the wear member 52 and such that the bottom edge 82 of the wear member 80 is located adjacent the second wall 64 of the lip 66. The lower wear member 80 also extends between the first side edge 46 and the second side edge 48 of the base member 40.

Each aperture 94 in the lower wear member 80 is aligned coaxially with a respective aperture 70 in the mounting member 58. The lower wear member 80 is removably attached to the mounting member 58 of the base member 40 by fasteners such as countersunk screws or bolts which extend through the apertures 94 and threadably engage the apertures 70. The rear surface 90 of the lower wear member 80 is adapted to engage the surface 68 located within the recess 60 such that the friction surface 92 of the lower wear member 80 is substantially coplanar with the friction surface 56 of the upper wear member 52. The lower wear member 80 is formed from a second material that is different from the first material which forms the upper wear member 52, such that the lower wear member 80 has a lower coefficient of friction than the upper wear member 52. The lower wear member 80 is preferably formed from cast iron which has a kinetic coefficient of friction with composite material of approximately 0.15. The coefficient of friction of the lower wear member 80 is therefore approximately one-half of the coefficient of friction of the upper wear member 52.

In operation, the base member 40 is welded to the second side 32 of the center post 28 of the saddle 22 in a vertical orientation with the upper wear member 52 located above the mounting member 58 and recess 60. The lower wear member 80 is then inserted into the recess 60 and is removably attached to the mounting member 58 of the base member 40 by threaded fasteners that extend into the apertures 70 in mounting member 58. The lower wear member 80 is thereby located vertically below the upper wear member 52. A wear plate assembly 20 is similarly attached to the first side 30 of the center post 28 of the saddle 22. The wear plate assembly 20 has a dual friction surface including the friction surface 56 and the friction surface 92, whereby the friction surface 56 of the upper wear member 52 has a first coefficient of friction and the friction surface 92 of the lower wear member 80 has a second coefficient of friction.

When a railcar is at tare weight, or unloaded, the friction wedge of the dampening assembly will slidably engage the steel friction surface 56 of the upper wear member 52 that has a coefficient of friction of approximately 0.30. When the railcar is at laden weight, or loaded, the friction wedge will slidably engage the cast iron friction surface 92 of the lower wear member 80 that has a coefficient of friction of approximately 0.15. The vertical dampening force created by the friction wedge at laden is thereby approximately one-half of the force that is created at tare. This reduction in the vertical dampening force component at laden weight leads to a reduction in the axle centralizing forces in curves which the wheel/rail friction forces must overcome in order to promote axle steering. Easier steering through tight curves and switches is also promoted by the reduction in the vertical dampening force when the railcar is laden.

Various features of the invention have been particularly shown and described in connection with the illustrated embodiment of the invention, however, it must be understood that these particular arrangements merely illustrate, and that the invention is to be given its fullest interpretation within the terms of the appended claims.

What is claimed is:

1. A wear plate assembly adapted to engage a friction wedge of a railroad car truck, said wear plate assembly including:

a first wear member adapted to be attached to the railroad car truck, said first wear member including a front friction surface adapted to engage the friction wedge, said first wear member being formed from a first material, and a second wear member adapted to be attached to the railroad car truck, said second wear member including a front friction surface adapted to engage the friction wedge, said second wear member adapted to be located adjacent said first wear member, said front friction surface of said second wear member adapted to be located generally coplanar with said first friction surface of said first wear member, said second wear member being formed from a second material, said second material being a different material than said first material.

2. The wear plate assembly of claim 1 wherein said first material that forms said first wear member comprises steel, and said second material that forms said second wear member comprises cast iron.

3. The wear plate assembly of claim 1 wherein said first material has a first kinetic coefficient of the friction with a third material, and said second material has a second kinetic coefficient of friction with the third material which is lower than said first coefficient of friction.

4. The wear plate assembly of claim 1 wherein said first material has a kinetic coefficient of friction with a third material of approximately 0.30 and said second material has a kinetic coefficient of friction with the third material of approximately 0.15.

5. The wear plate assembly of claim 1 including a mounting member attached to said first wear member, said mounting member adapted to be attached to the railroad car truck and said second wear member adapted to be attached to said mounting member.

6. The wear plate assembly of claim 5 wherein said mounting member includes a recess adapted to receive said second wear member.

7. A wear plate assembly adapted to engage a friction wedge of a railroad car truck, said wear plate assembly including:

a base member including a first wear member and a mounting, member, said first wear member including a front friction surface adapted to engage the friction wedge, said mounting member being located adjacent said first wear member, said mounting member including a recess and a lip member extending adjacent to said recess; and a second wear member having a front friction surface adapted to engage the friction wedge, said second wear member adapted to be located within said recess of said mounting member of said base member.

8. The wear plate of claim 7 wherein said second wear member includes one or more apertures for removably attaching said second wear member to said mounting member.

9. The wear plate assembly of claim 7 wherein said front friction surface of said second wear member is adapted to be located generally coplanar with said front friction surface of said first wear member.

10. The wear plate assembly of claim 7 wherein said first wear member is formed from a first material and said second wear member is formed from a second material.

11. The wear plate assembly of claim 10 wherein said first material comprises steel and said second material comprises cast iron.

12. The wear plate assembly of claim 10 wherein said first material has a first kinetic coefficient of friction with a third material and said second material has a second kinetic coefficient of friction with the third material which is lower than said first coefficient of friction.

13. The wear plate of claim 10 wherein said first material has a kinetic coefficient of friction with a third material of approximately 0.30 and said second material has a kinetic coefficient of friction with the third material of approximately 0.15.

14. A wear plate assembly adapted to engage a friction wedge of a railroad car truck, said wear plate assembly including:

a base member including a first wear member and a mounting member, said first wear member including a front friction surface adapted to engage the friction wedge, said mounting member being located adjacent said first wear member; and a second wear member having one or more apertures and a front friction surface adapted to engage the friction wedge, said one or more apertures adapted to removably attach said second wear member to said mounting member.

15. A wear plate assembly adapted to engage a friction wedge of a railroad car truck, said wear plate assembly including:

a base member including a first wear member and a mounting member, said first wear member including a front friction surface adapted to engage the friction wedge, said first wear member being formed from a first material comprising steel, said mounting member being located adjacent said first wear member; and a second wear member having a front friction surface adapted to engage the friction wedge, said second wear member being formed from a second material comprising cast iron, said second wear member adapted to be mounted to said mounting member of said base member.

* * * * *